US007246387B2

(12) United States Patent
Erickson et al.

(10) Patent No.: US 7,246,387 B2
(45) Date of Patent: Jul. 24, 2007

(54) FOOD PREPARATION STATION

(75) Inventors: E. Jay Erickson, 5412 Buffalo Rd., Erie, CO (US) 80516; Andrew Gordon, Brighton, CO (US)

(73) Assignee: E. Jay Erickson, Erie, CO (US)

( * ) Notice: Subject to any disclaimer, the term of this patent is extended or adjusted under 35 U.S.C. 154(b) by 198 days.

(21) Appl. No.: 10/913,302

(22) Filed: Aug. 5, 2004

(65) Prior Publication Data

US 2005/0067747 A1 Mar. 31, 2005

Related U.S. Application Data

(63) Continuation-in-part of application No. 10/299,621, filed on Nov. 18, 2002.

(51) Int. Cl.
*E03C 1/33* (2006.01)

(52) U.S. Cl. ..... 4/631; 4/654

(58) Field of Classification Search ..... 4/619, 4/630–631, 637–638, 654, 656, 659
See application file for complete search history.

(56) References Cited

U.S. PATENT DOCUMENTS

| | | | | |
|---|---|---|---|---|
| D35,008 | S | 8/1901 | Clow | |
| 2,175,329 | A | 10/1939 | Watt | |
| D161,596 | S | 1/1951 | Russ | |
| 2,609,024 | A | 9/1952 | Russ | |
| D244,030 | S | 4/1977 | Tongish | |
| 4,229,858 | A | 10/1980 | Baxter et al. | |
| 4,243,184 | A | 1/1981 | Wright | |
| D262,931 | S | 2/1982 | LeVan | |
| 4,462,126 | A | 7/1984 | Cleaveland | |
| 4,765,603 | A | 8/1988 | Huppert | |
| 5,012,537 | A | 5/1991 | Underwood | |
| 5,546,852 | A | 8/1996 | Bidwell | |
| 5,865,105 | A | 2/1999 | Pepelanov | |
| 5,904,271 | A | 5/1999 | Collins et al. | |
| 5,915,851 | A | 6/1999 | Wattrick et al. | |
| 5,934,298 | A | 8/1999 | Singh | |
| 5,996,983 | A | 12/1999 | Laurenzi | |
| 6,276,675 | B1 | 8/2001 | Shamoon | |
| D479,586 | S * | 9/2003 | Piatt | D23/284 |
| 6,631,525 | B2 * | 10/2003 | Piatt et al. | 4/619 |
| 7,000,266 | B2 * | 2/2006 | Piatt et al. | 4/619 |

* cited by examiner

OTHER PUBLICATIONS

"American Standard Magazine Advertisement", obtained from Good Housekeeping Magazine, Sep. 2002 issue. Good Housekeeping, 959 8th Avenue, New York, New York 10019.

*Primary Examiner*—Charles E. Phillips
(74) *Attorney, Agent, or Firm*—Timothy J. Martin; Michael R. Henson; John W. Carpenter

(57) ABSTRACT

A sink assembly supported by a countertop surface or a freestanding cabinet to form a food preparation station is provided. The sink assembly includes a sink basin, a stanchion, a cutting board supported by the stanchion, and a coupling member fastening the cutting board and stanchion. The stanchion has first and second uprights extending between lower edges that are coextensive with the basin floor and terminating in a platform spanning therebetween. Mounts, such as slotted brackets, releasably secure the stanchion to the basin floor. The coupling member may be first and second pairs of cooperating fasteners associated with the cutting board and platform. The fasteners can be a cooperating tab and slot and a cooperating spring clip and peg. The basin floor may be sloped in multiple directions while the cutting board, when coupled to the stanchion, extends generally parallel to the horizontal plane of the support surface.

41 Claims, 9 Drawing Sheets

FOOD PREPARATION STATION

FIELD OF THE INVENTION

The present invention generally relates to sinks and sink assemblies such as those commonly found in kitchens and restaurants. More particularly, the present invention is directed to a sink assembly that may be supported by a countertop or a freestanding cabinet to form a food preparation station. The invention specifically concerns sink assemblies that incorporate a cutting board to define a food preparation surface associated with the sink

BACKGROUND OF THE INVENTION

Most residential dwellings and commercial establishments have a room or place equipped for the preparation and cooking of food commonly referred to as a kitchen. Many kitchens provide a sink, cabinets, countertop space and various appliances, such as ovens, stoves, and dishwashers. A commonplace item also found in either a household or a commercial kitchen is a cutting board. Cutting boards typically provide a planar food preparation surface for chopping, slicing, and dicing food products and are useful for transferring the prepared food to a different area of the work place, serving platter, tray, pan, pot, or other cookware. Cutting boards vary in size, style, composition, and color and are typically placed on a countertop or kitchen appliance to protect the underlying surface and to reduce wear on the utensil used to prepare the food.

There are, however, various problems associated with traditional cutting boards that limit their effectiveness and convenience. For example, transferring the prepared food from the cutting board surface to a different area of the work place or to cookware may be hindered because the combined weight of the food and the cutting board is too heavy to lift. Also, transferring food from the cutting board surface may be difficult because the cutting board has become too wet with associated food juices such that lifting the cutting board would cause the juices to spill onto the floor creating both a mess as well as a hazard. As a result, transferring the prepared food from the cutting board to its destination may involve a time consuming movement of individual pieces.

Another problem associated with traditional cutting boards is the ability to thoroughly cleanse the area surrounding the cutting board after the food has been prepared. Oftentimes, while food is being prepared, waste materials, such as the fat trimmed off meats, will foul the surface of the cutting board. Typically, such waste materials are simply scraped off the cutting board and onto the countertop so as not to interfere with the food preparation. Accordingly, the countertop surface will be littered with discarded food materials requiring that it be cleansed. Thoroughly cleansing the countertop surface may involve the movement of countertop items, which can be time consuming, and may also involve the very difficult task of cleansing crevices in the countertop surface such as may exist between the juncture of the countertop with an appliance.

One solution to the above-mentioned problems is a cutting board designed to straddle a sink basin such as described in U.S. Pat. No. 4,765,603 ("the '603 Patent") to Huppert. The cutting board disclosed therein allows for the simultaneous use of the food preparation surface, sink basin, and water faucet. Since the cutting board straddles the sink basin, a serving tray or other cookware may be placed beneath the cutting board for the easy transfer of the prepared food. Also, a cutting board of this design allows the convenient disposal of waste material since it may simply be scraped into the sink for drainage to a garbage disposal. Further, sink accessories, such as a faucet and sink sprayer are readily available for cleansing both the sink basin and the cutting board.

A cutting board having a design such as that disclosed the '603 Patent may have various drawbacks. For example, if the cutting board is not properly secured over the sink basin, it may tend to slide shift during the food preparation. Also, the cutting board may obstruct the use of the faucet while suspended over the sink basin such that one may not be able to wash his or her hands until the cutting board is removed. To address these drawbacks, I disclosed a new and useful food preparation station in my co-pending U.S. application Ser. No. 10/299,621, filed Nov. 18, 2002, the contents of which are incorporated herein by reference.

In that application, I disclosed various food preparation stations that incorporate sink assemblies that generally include a sink basin with a stanchion and cutting board disposed in the interior of the sink basin. As disclosed, the stanchion, which supports the cutting board, extends upwardly from the sink basin floor and integrally formed as a one-piece construction with the sink basin floor. The cutting board, supported by the stanchion, provides a planar food preparation surface that could be permanently secured to the stanchion, or adapted to be removably secured to the stanchion. In addition, the sink basin sidewall, which surrounds the basin interior, has a front wall that may be provided with a gap or section of reduced height that facilitates access to the cutting board.

While the food preparation stations and sink assemblies disclosed in my copending application improves upon food preparation area and addresses various problems associated with traditional cutting boards, there still remains a need to provide a preparation area that may be thoroughly and efficiently cleaned and sanitized and that is more versatile to accommodate the various needs of its users while still making an efficient use of space. The present invention is directed to meeting these needs.

SUMMARY OF THE INVENTION

An object of the present invention is to provide a new and useful kitchen apparatus for the preparation of food.

Another object of the present invention is to provide a sink assembly that incorporates a cutting board to provide a food preparation area that makes efficient use of space.

Yet another object of the present invention is to provide a food preparation station that incorporates a sink assembly with an easily accessible cutting board that may be secured against movement during use and subsequently released when not in use.

A still further object of the present invention is to provide a food preparation area that is associated with sink accessories such as faucets and associated plumbing to facilitate the cleaning and sanitizing of the preparation area as well as storage areas for the convenient storage of food, cooking utensils and other food preparation items.

Yet another object of the present invention is to provide a food preparation station that provides for the convenient transfer of prepared food to a serving tray or other cookware and the disposal of waste materials.

Still another object of the present invention is to provide a sink assembly with a removable food preparation surface to enhance its versatility.

According to the present invention, then, a food preparation station that includes a sink assembly supported in a generally horizontal plane by a horizontal support surface. The general components of the sink assembly include a sink basin, mounts, and a food preparation apparatus. The sink basin has a basin floor with a drain opening formed therethrough and a basin sidewall extending upwardly therefrom. The basin floor may slope downwardly toward the drain opening relative to the horizontal support surface. The basin sidewall has a back wall terminating in a rearwardly projecting flange that is oriented in a first plane and a front wall spaced apart from the back wall. The front wall may have a section of reduced height relative to the flange with an upper edge thereof generally parallel to the first plane. The basin sidewall further includes end walls extending between the front and back walls. Optionally, the front wall may be arcuate in shape such that it bows out away from the back wall and relative to a vertical plane that is generally perpendicular to the horizontal plane of the support surface.

A food preparation apparatus is supported by the sink basin floor and generally includes a stanchion, a cutting board supported thereby, and a coupling member adapted to releasably fasten the cutting board to the stanchion. The stanchion has two spaced apart upright supports that extend upwardly from the basin floor when disposed thereon. The upright supports may terminate in a platform or, in the alternative, include a bridge piece that spans or otherwise interconnects the upright supports. The upright supports may be in the form of sidewalls wherein each sidewall has a lower edge that is coextensive with the basin floor such that, when in confronting relationship to the basin floor, the stanchion platform extends in a plane generally parallel to the horizontal plane of the support surface. The stanchion may be formed of materials selected from a group consisting of stainless steel and porcelain. Mounts disposed or otherwise affixed to the basin floor are adapted to couple the stanchion to the basin floor. More particularly, mounts in the form of slotted brackets adapted to receive a respective one of the stanchion sidewalls releasably secure the stanchion to the basin floor.

The cutting board is supported by the stanchion and has a food preparation surface and an oppositely facing bottom surface. If a platform is provided on the stanchion, the bottom surface of the cutting board confronts the platform. The cutting board is formed of a material selected from the group consisting of wood, plastic, ceramic, marble, and a polymethyl methocrylate resin containing a uniformly dispersed alumina trihydrate filler.

The cutting board is releasably fastened to the stanchion platform by a coupling member or a plurality of coupling members adapted to restrain movement of the cutting board relative to the platform of the stanchion. The coupling member may be a pair of cooperative fasteners disposed respectively on the platform and on the cutting board and located to secure to one another when in the assembled state so as to releasably secure the cutting board to the platform. The pair of cooperative fasteners are selected from a group consisting of tabs and slots, pegs and clips, magnets, snaps, and hoop and loop fasteners. More specifically, one pair of cooperative fasteners may include a tab disposed on the bottom surface of the cutting board and a slot formed in the platform of the stanchion that is sized and adapted to receive the tab and be engaged thereby when assembled. An alternative pair of cooperative fasteners could include a spring clip disposed on the platform and a peg disposed on the bottom surface of the cutting board and operative to engage the clip.

Sink assembly may further include an auxiliary tray that is adapted to be placed on and supported by the basin floor to define a transfer state. Preferably, when the food preparation apparatus is disposed on the basin floor a portion of the cutting board extends beyond the stanchion platform to define an overhanging lip that extends over the auxiliary tray. Further, the cutting board may also extend over the drain-opening, or, alternatively, the cutting board and stanchion platform may include a cut out portion that each, respectively, substantially contour around a vertical projection of the drain opening.

These and other objects of the present invention will become more readily appreciated and understood from the consideration of the following detailed description of the exemplary embodiments when taken together with the accompanying drawings, in which:

DETAILED DESCRIPTION OF THE EXEMPLARY EMBODIMENTS

The present invention relates to a new and useful food preparation apparatus as well as sink assemblies supported by a countertop surface or a freestanding cabinet to form a food preparation station. The term "food preparation station" should be understood to mean a designated area or place equipped to provide an individual with a convenient location for preparing food. The food preparation apparatus of the present invention generally includes a cutting board supported by a stanchion. The cutting board may be any traditional cutting board that is adapted to be removably secured to the stanchion so as to provide a sturdy, planar surface for the preparation of food.

Additionally, the food preparation apparatus may be combined with a sink basin wherein the basin floor supports the stanchion. The sink assembly may be supported by a countertop associated with a row of integrally attached cabinets or may be supported by a freestanding cabinet. The interior cabinet space beneath the sink assembly may house various selected appliances such as a refrigerator, garbage compactor, dishwasher, icemaker, or other appliances useful in the kitchen.

Figure 1:
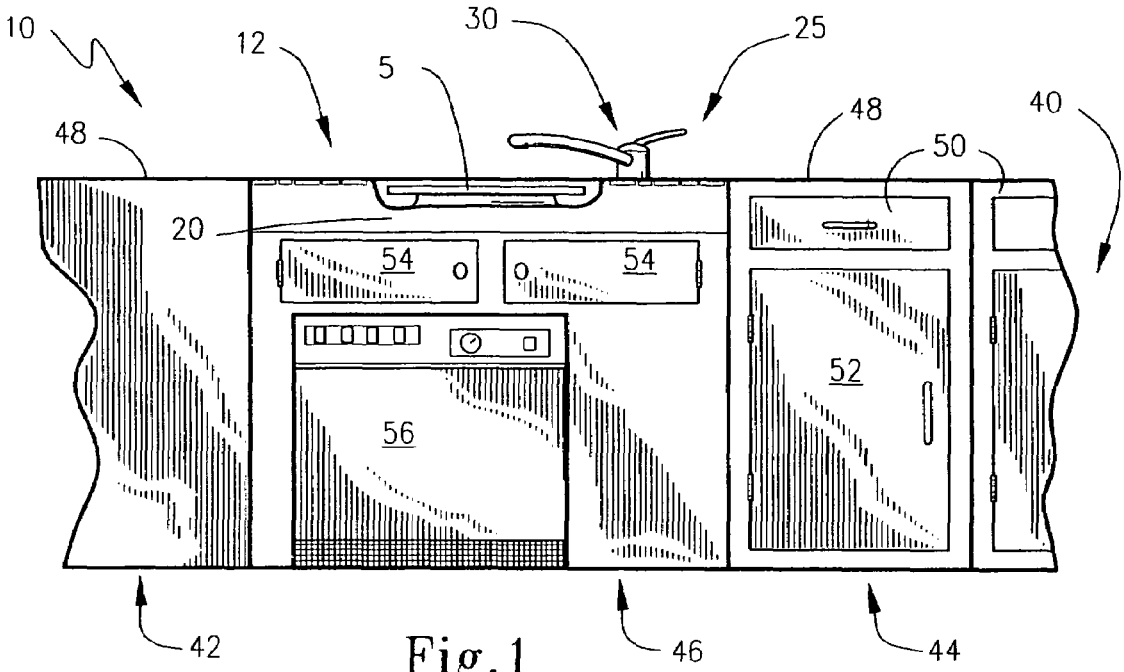
FIG. 1 is a front view in elevation of a sink assembly mounted in a cabinet system to form a food preparation station all according to a first embodiment of the present invention.
Figure 2:
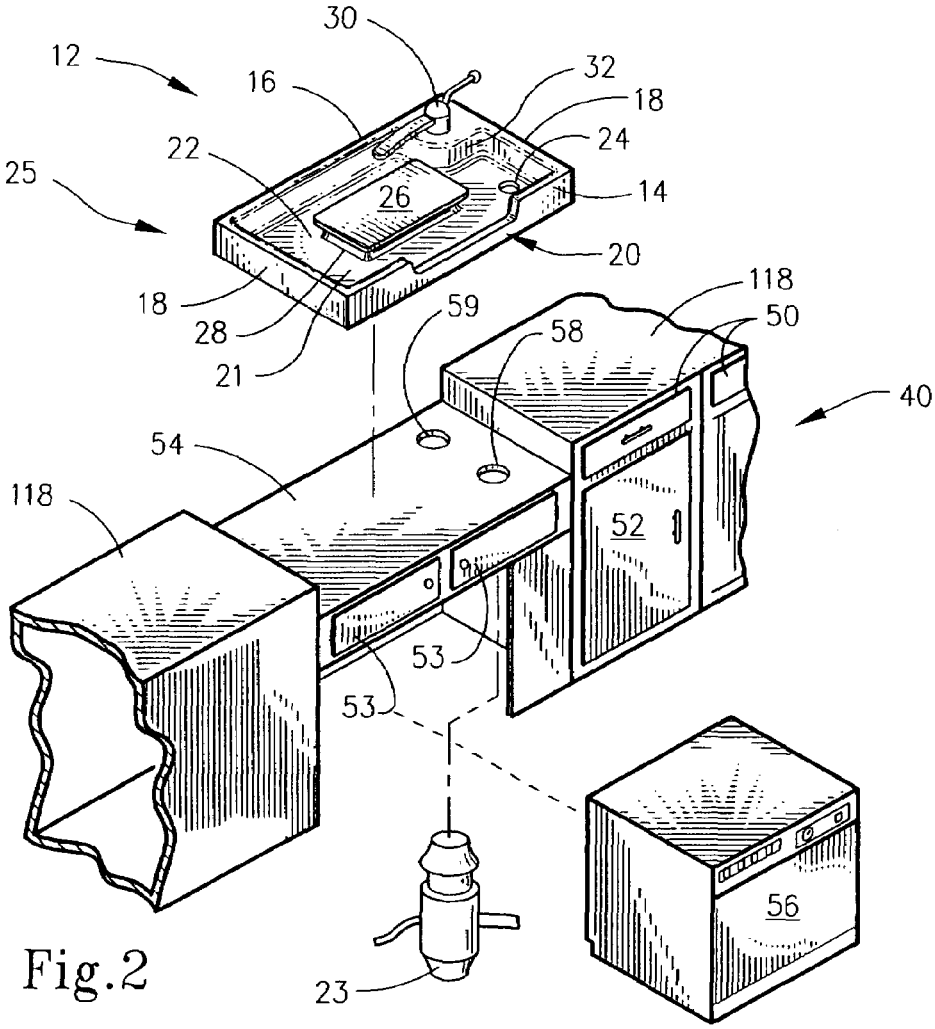
FIG. 2 is an exploded perspective view of the sink assembly and cabinet that combine to form the food preparation station shown in FIG. 1.

To better understand the present invention, reference is first made to FIGS. 1 and 2, which show a first exemplary embodiment of the sink assembly and cabinet. In FIGS. 1 and 2, a food preparation station 10 is formed by sink assembly 12 and cabinet 40. As shown in FIG. 2, sink assembly 12 includes front wall 14, back wall 16, and end walls 18, each of which extend upwardly from basin floor 22 as an integral extension thereof to form sink basin 25. Sink basin 25 may be constructed of a material that is commonly known in the art such as porcelain, stainless steel, and the like, and its dimensions may be suited to fit the needs of either a residential kitchen or a commercial kitchen. Sink basin floor 22 includes drain opening 24 that may be in fluid communication with an arrangement of pipes for carrying off waste water, or, as shown, in fluid communication with a garbage disposal 23.

In addition, as shown in both FIGS. 1 and 2, sink assembly 12 includes faucet 30 and cutting board 26 supported by stanchion 28. The use of the term "stanchion" should be understood to mean an upright pole, post, or support. As such, a stanchion may further include a surrounding sidewall of any selected geometry, including rectangular parallelpided, polyhedral, conical, cylindrical, pyramidal, etc. As will be described in further detail below, stanchion 28 may be integrally formed as a one-piece construction with sink basin floor 22, or, in the alternative, may be a separate component that is removably disposed on the basin floor. The stanchion may be formed of any suitable material for supporting the cutting board and thus may be formed of porcelain, stainless steel, or other suitable materials known to the person of ordinary skill in the art.

Cutting board 26 provides a planar cutting surface for the preparation of food and may be adapted to be removably secured to stanchion 28. Cutting board 26 may be constructed of any suitable material for the preparation of food such as wood, plastic, marble, or a polymethyl methocrylate resin containing a uniformly dispersed alumina trihydrate filler, which is manufactured by E.I. DuPont de Nemours & Co. and sold under the trademark "CORIAN". To facilitate access thereto, a portion of front wall 14 of sink basin 25 may have an area of reduced height relative to back wall 16 so as to form a gap 20 thereby to expose edge 5 of cutting board 26.

Also, as is shown in FIGS. 1 and 2, sink assembly 12 may further include a faucet 30. In this particular embodiment, faucet 30 is mounted on platform 32, which is located in the interior 21 of sink basin 25. As should be understood, the present invention is not limited to the construction of faucet 30 shown here, or in the other figures of the present disclosure, and a variety of suitable sink faucet constructions are contemplated.

With continued reference to FIGS. 1 and 2, cabinet 40 supports sink assembly 12. For discussion purposes, cabinet 40 may be visually divided into three (3) sections; left section 42, right section 44, and center section 46. Left section 42 and right section 44 each have a top surface 48 in the form of a countertop. Right section 44 further includes drawers 50 and cabinet doors 52. The interior space of drawers 50 and cabinet doors 52 may be used as storage area for food preparation items or any items capable of fitting into their interior space. Center section 46, on the other hand, includes dishwasher 56. As should be understood, center section 46 is not limited to a construction that includes dishwasher 56, but rather may also include drawers and cabinet doors. Alternatively, interior space of center portion 46 may also be used to house other appliances such as garbage compactor, a refrigerator unit, an icemaker or other appliance capable of fitting within the available interior space. In addition, center section 46 includes access panels 53. While not in association with drawers, access panels 53 provide access into the interior of center section 46 so that the plumbing or the sink assembly may be serviced for repairs or routine maintenance. As will be discussed in further detail below, access panels 53 provide access to the structure that fastens the cutting board to the stanchion.

As best shown in FIG. 2, sink assembly 12 is adapted to be set upon platform 54 of center section 46. Platform 54 includes apertures 58 and 59 that align respectively with drain opening 24 and faucet 30 to allow for the appropriate plumbing may be connected thereto.

As stated above, sink basin 25 may be constructed to suit the needs of either a residential kitchen or a commercial kitchen. As contemplated, then, the basin of the sink assembly could extend beyond the length and depth of an average residential sink basin for either residential or commercial purposes. For example, sink basin 25 shown in FIG. 1 could extend the length of the countertop 48. A sink basin of sufficient dimensions could accommodate a plurality of spaced apart stanchions and cutting boards mounted thereon such that more than one person may work at the food preparation station at one time. Alternatively, the food preparation station could be in the form of a center island.

Figure 3:
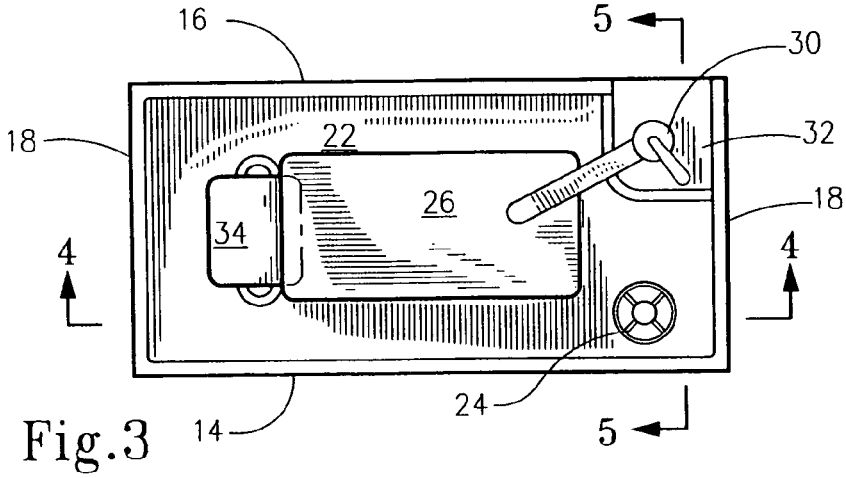
FIG. 3 is a top plan view of the sink assembly shown in FIGS. 1 and 2 with a tray in a food transfer position.

Turning now to FIG. 3, sink assembly 12 of FIGS. 1 and 2 is shown to include auxiliary tray 34. Auxiliary tray 34 is positioned upon sink basin floor 22 in the food transfer position. Auxiliary tray 34 may be any type of receiving tray, plate, bowl, cookware, etc. for receiving prepared food that is scraped off of cutting board 26. As shown, an outward margin of cutting board 26 overhangs auxiliary tray 34 to facilitate the transfer of the prepared food to the tray. Auxiliary tray 34 and the prepared food may then be transferred to the desired location.

Figure 4:
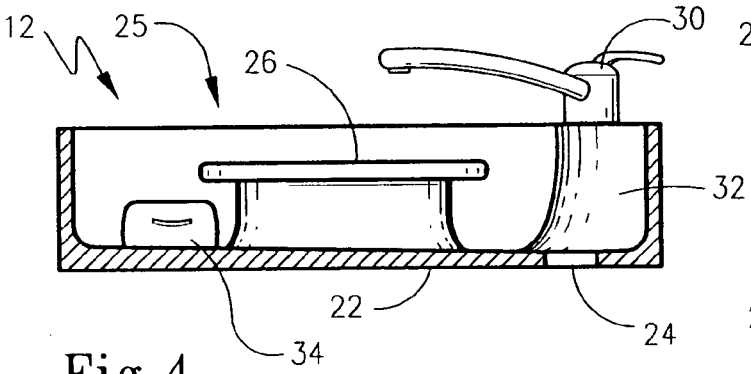
FIG. 4 is a cross sectional view of the sink assembly shown in FIG. 3 taken about lines 4-4.
Figure 5:
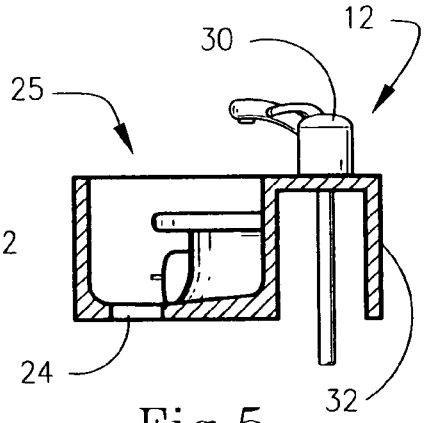
FIG. 5 is a cross sectional view of the sink assembly shown in FIG. 3 taken about the lines 5-5.

With reference now to FIGS. 4 and 5, sink basin floor 22 may be constructed to slope at an angle with respect to its horizontal support surface. Specifically, as shown in FIG. 4, sink basin floor 22 slopes downwardly from serving tray 34 to drain opening 24. In addition, as shown in FIG. 5, sink basin floor may also slope in a second direction, for example, downwardly from platform 32 to drain opening 24. The slope of sink basin floor 22 facilitates the cleansing of sink basin 25 by directing water, and thus waste material, to the general direction of drain opening 24. However, if desired, sink basin floor 22 need not be constructed to slope in either direction.

Figure 7:
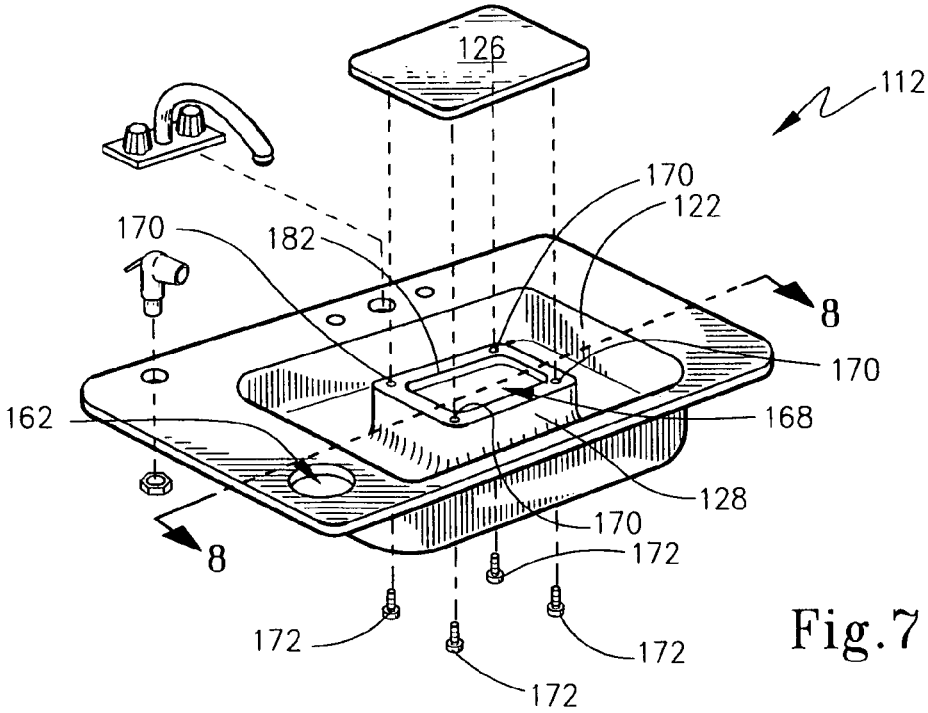
FIG. 7 is an exploded view of the sink assembly shown in FIG. 6.
Figure 6:
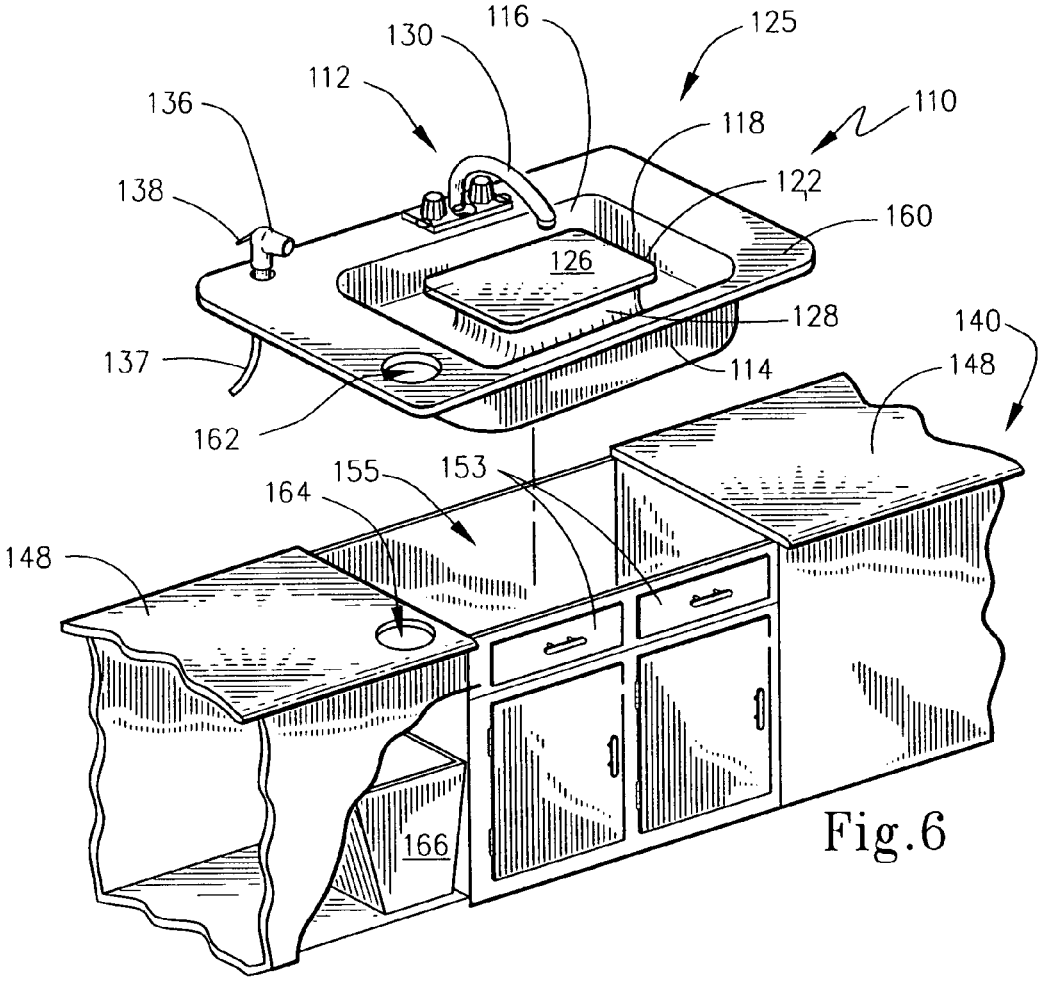
FIG. 6 is an exploded perspective view of a sink assembly and a cabinet, partially broken away, that combine to form a food preparation station all according to a second embodiment of the present invention.

A second exemplary embodiment of a food preparation station according to the present invention is shown in FIGS. 6 and 7. In this second embodiment, sink assembly 112 and cabinet 140 combine to form food preparation station 110. Sink assembly 112 includes sink basin 125, which is similar to sink basin 25 of FIGS. 1-5 in that it is formed of front wall 114, back wall 116, and end walls such as end wall 118 that extend upwardly from sink basin floor 122 as an integral one-piece construction. Sink basin 125 also includes an outwardly projecting flange 160 that is adapted to be supported by countertop 148 of cabinet 140. Located about flange 160 are several sink accessory items, namely, faucet 130, sink spray 136, and aperture 162. Sink sprayer 136 is a common kitchen sink accessory that is associated with hose 137 and trigger 138. Sink sprayer 136 may be pulled from its stationary position and used by depressing trigger 138 to cleanse the interior of sink basin 125 and wash waste materials toward the drain opening (not shown).

Sink assembly 112 also includes aperture 162 formed through flange 160. A corresponding aperture 164 is formed through countertop 148 of cabinet 140 and is in communication with waste receptacle 166. Cabinet 140 includes bay 155 that is sized and adapted to receive sink basin 112. When sink assembly 112 is disposed in bay 155 and supported by countertop 148, apertures 162 and 164 uniformly align with one another so that waste materials can be deposited directly into waste receptacle 166. The use of apertures 162 and 164 avoids the need of having to transfer the waste materials to a waste receptacle that is removed from the food preparation station thus providing a more convenient work place. Cabinet 140 further includes access panels 153 and cabinet doors 152. Cabinet doors 152 provide an entryway into the interior of cabinet 140 for the storage of items, but also to provide access to the plumbing and sink assembly 112.

As mentioned above with respect to FIGS. 1-6, and as contemplated by the present invention, the sink assembly component of the food preparation includes a cutting board supported by a stanchion located within the interior of the sink basin. Both the stanchion and the mechanism by which the cutting board is secured to the stanchion are discussed in greater detail with respect to FIGS. 7-9. FIG. 7 shows an exploded view of the sink assembly component of food preparation station 110 shown in FIG. 6. As shown, stanchion 128 stanchion extends upwardly from sink basin floor 122 as an integral one piece construction to create an interior space 168. Stanchion 128 may be formed as die cut, stamped-out piece formed through sink basin floor 122. The top surface 182 of stanchion 128 provides a seat for cutting board 126. Further, top surface 182 includes an outward margin that overhangs interior space 168 to accommodate apertures 170, which are used for the securement of cutting board 126 by threaded screws 172. The overhanging margin of top surface 182 is shown in FIGS. 8 and 9 discussed below.

Figure 8:
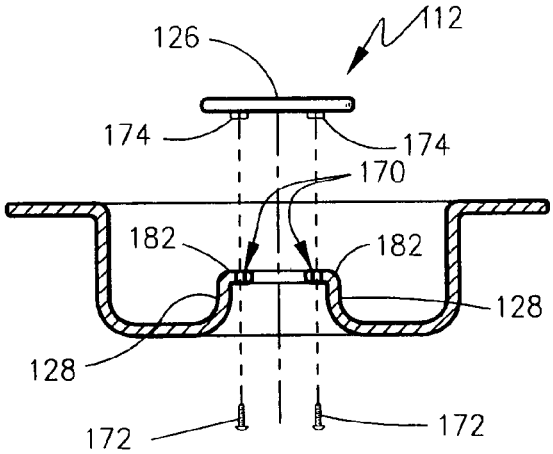
FIG. 8 is a cross-sectional view of the sink assembly shown in FIG. 7 taken about lines 8-8 that shows one possible structure for fastening the cutting board to the stanchion sidewall.

As shown in FIG. 8, apertures 170 are formed through the overhanging margin of top surface 182 so that threaded screws 172 may pass through apertures 170 and be received by plates 174 mounted on cutting board 126. Screws 172 are tightened into plates 174 for securement of cutting board 126 to stanchion 128. It should be understood that apertures 170, which are shown in FIG. 7 to be located at the corners of the stanchion sidewalls, are not limited to this location, but may be placed at any location that would provide adequate securement of the cutting board. The present invention contemplates that the fasteners be removable so that cutting board 126 may be released from securement to be cleansed.

Figure 9:
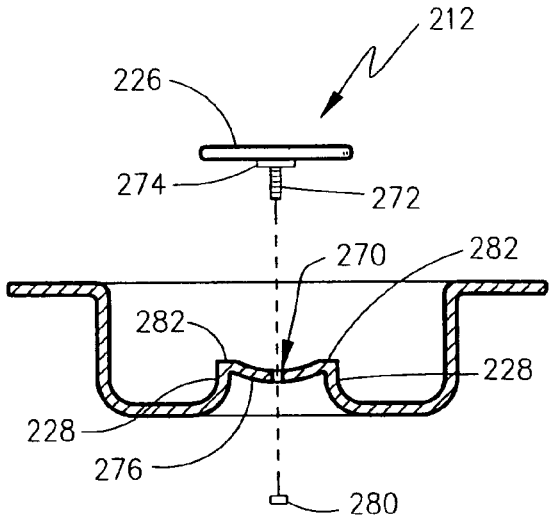
FIG. 9 is a cross-sectional view of a sink assembly showing another structure by which the cutting board may be fastened to the stanchion sidewall.

An alternative structure for securing a cutting board to the stanchion is shown in FIG. 9. Here again, stanchion 228 includes upwardly extending sidewalls that are integrally formed from sink basin floor 222. Stanchion 228 has a top surface 282 to provide a seat for cutting board 226. Stanchion 228 also includes bridge portion 276 interposed between the stanchion sidewalls with aperture 270 formed therethrough. Aperture 270 is operative to receive a fastener for the securement of cutting board 226. In this particular embodiment, the cutting board fastener is in the form of a centrally located screw 272 that is secured to cutting board 226. Aperture 270 is adapted to receive cutting board screw 272 when cutting board 226 is seated on top surface 282. Nut 280 may then be used to secure cutting board 226 in place.

Figure 10:
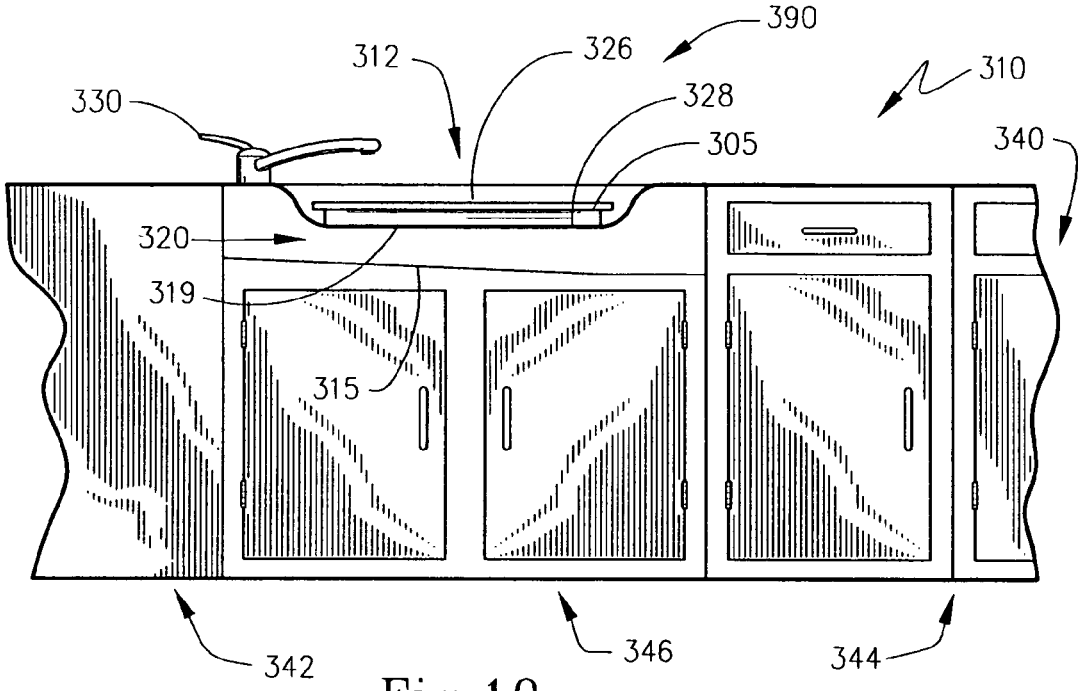
FIG. 10 is a front view in elevation of sink assembly mounted in a cabinet system to form a food preparation station all according to a third exemplary embodiment of the present invention.
Figure 11:
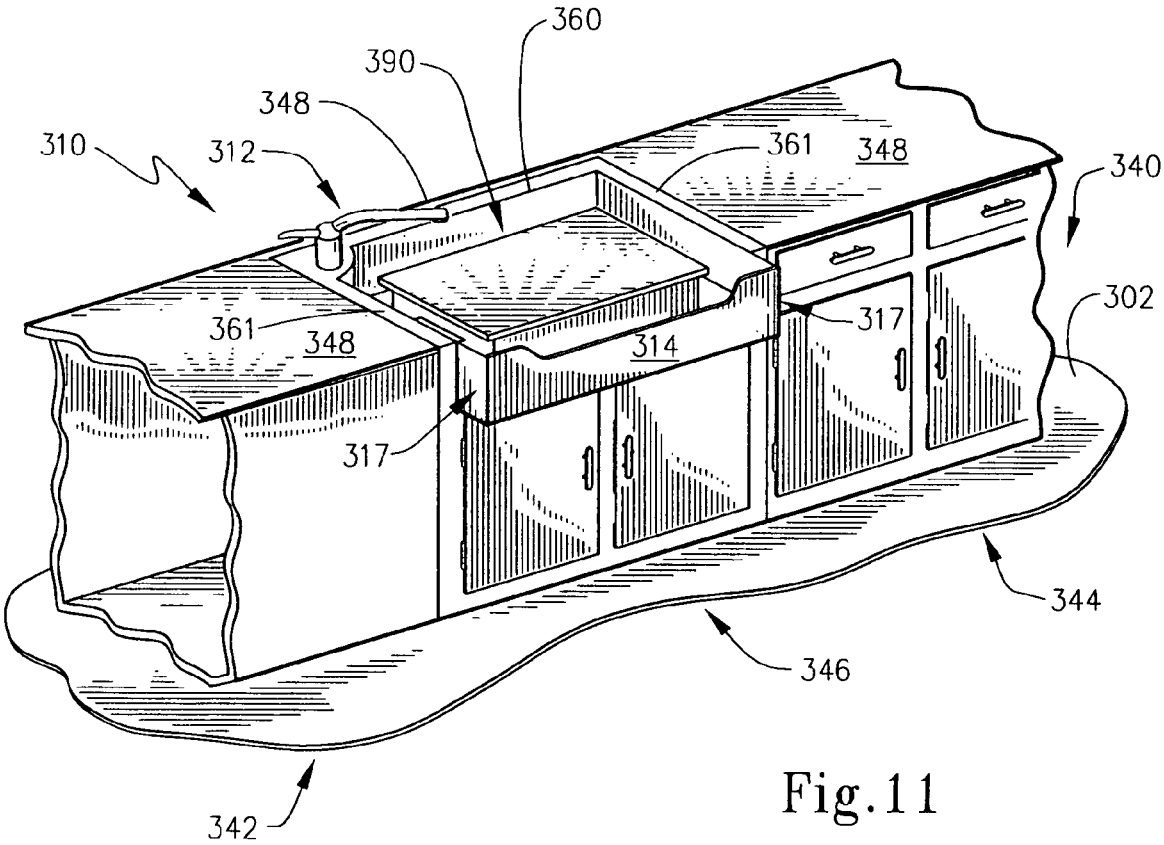
FIG. 11 is a perspective view of the food preparation station shown in FIG. 10.
Figure 12:
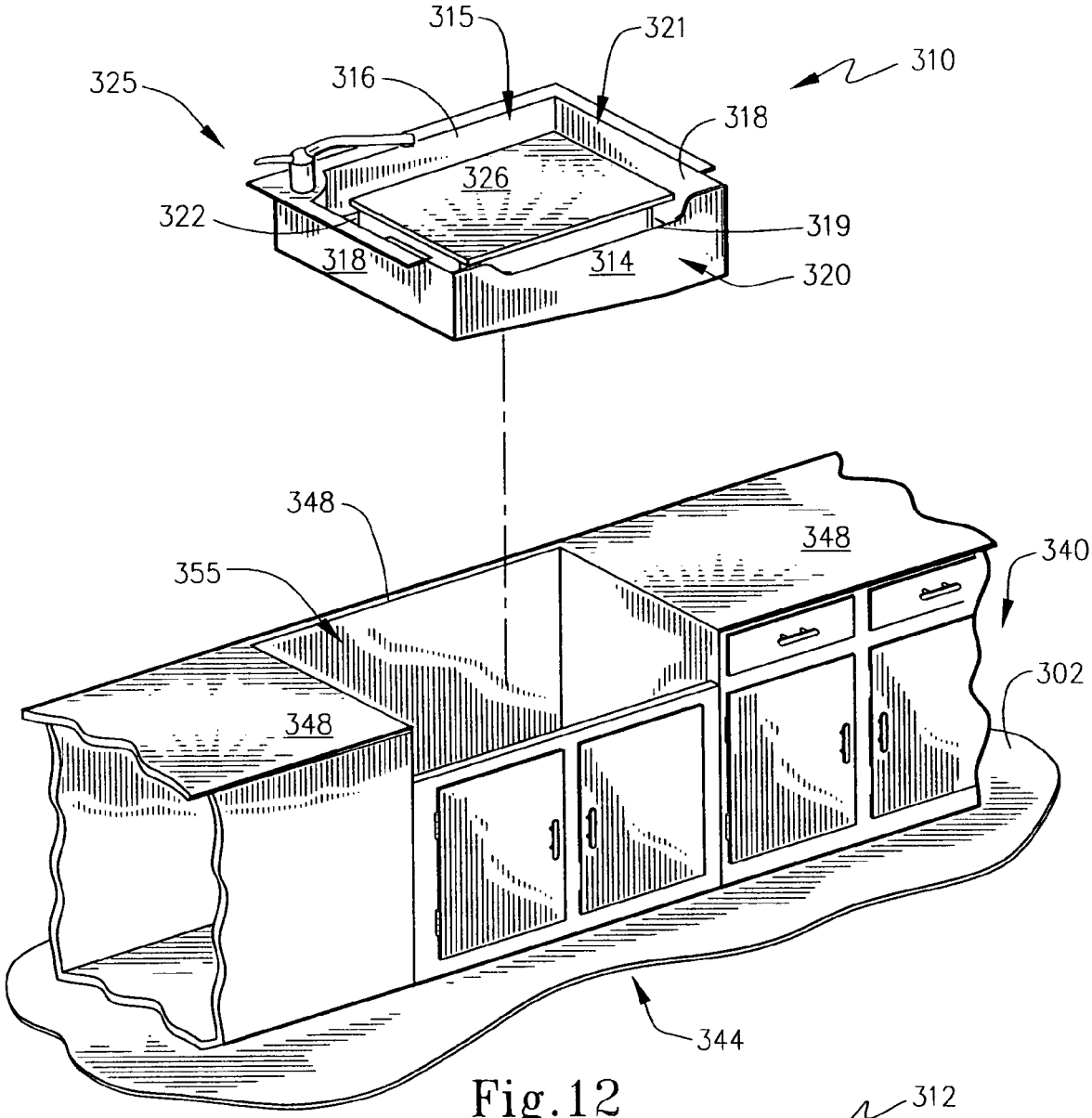
FIG. 12 is an exploded perspective view of the sink assembly and cabinet, partially broken away, that combine to form the food preparation station shown in FIG. 10.
Figure 13:
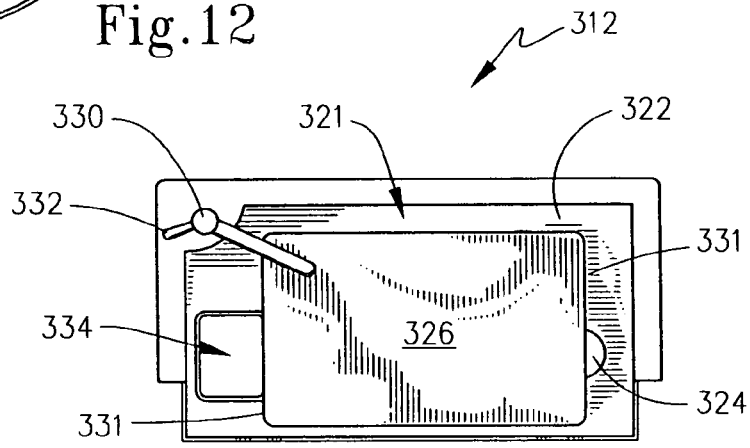
FIG. 13 is a top plan view of the sink assembly shown in FIG. 10.

A third exemplary embodiment of the food preparation station according to the present invention is generally shown in FIGS. 10-12. Similar to the food preparation stations shown and described above with respect to FIGS. 1, 2, 6, and 7, food preparation station 310 includes sink assembly 312 supported by cabinet 340. However, as will be understood from the following description, the sink assembly according to this embodiment has various features that are different than those heretofore described. For example, the stanchion is coupled to the basin floor by a mount such that it is releasably securable to the basin floor. Also, the fasteners that couple the cutting board to the stanchion are different from those described above such that they restrain movement of the cutting board relative to the stanchion during use, but also facilitate the removal of the cutting board therefrom when not in use.

With reference then to FIGS. 10-12, cabinet 340 is shown supported by a support surface such as floor 302, which is oriented in a generally horizontal plane. Cabinet 340 supports sink assembly 312 such that it too is oriented in plane that is generally parallel to and spaced below the horizontal plane of floor 2 when supported thereby. As described above, cabinet 340 may be visually divided into three (3) sections; left section 342, right section 344, and center section 346. Each cabinet section 342, 344, and 346 has a top surface 348 in the form of a countertop and each section may further include an interior space for storage or for housing selected appliances such as a garbage compactor, a garbage disposal, a refrigerator unit, an icemaker or other appliance capable of fitting within the available interior space. Center section 344 further includes bay 355, which is formed therein and sized and adapted to receive at least a majority of sink assembly 312.

With continued reference to FIGS. 10-12, sink assembly 312 generally includes a sink basin 325, faucet 330, auxiliary tray 334, and food preparation apparatus 390. Food preparation apparatus 390 is located in the sink basin interior 321 and generally includes two components, cuffing board 326 supported by stanchion 328. Sink basin 325 includes a basin sidewall formed by front wall 314, back wall 316 spaced apart from front wall 314, and a pair of end walls 318. Each wall 314, 316, and 318 extend upwardly from basin floor 322 as an integral one-piece construction.

Back wall 316 terminates in a rearwardly projecting flange 360 that is oriented in a first plane. Similarly, a majority of each end wall 318 terminates in a respective laterally projecting flange 361. Flanges 360 and 361 are adapted to be seated on countertop 348 thereby to suspend sink basin 325 in bay 355. As perhaps best shown in FIG. 11, when flanges 360 and 361 are seated on countertop 348, a portion 317 of each end wall 318 extends outwardly beyond countertop 348 such that front wall 314 is not flush with countertop 348. In this way, sink basin 325 is not limited to the width of the countertop to accommodate the food preparation apparatus and other desired accessory items.

With continued reference to FIGS. 10-12, front wall 314 has a gap or section of reduced height 320 relative to rearwardly projecting flange 360 of back wall 316. The section of reduced height 320 has an upper edge 319 that is generally parallel the first plane in which flange 360 of back wall 316 is oriented. The section of reduced height 320 exposes edge 305 of cutting board 326 facilitating access to cutting board 326.

The various components of sink assembly 312 will now be described in further detail with reference to FIGS. 13-16. As mentioned above, the sink basin sidewall extends upwardly from the basin floor. Basin floor 322 includes drain-opening 324 that is preferably in fluid communication with a garbage disposal. As perhaps best shown in FIG. 16, basin floor 322 is constructed to slope downwardly toward drain opening 324. To effect the downward sloping of basin floor 322, front wall 314 may have a lower edge 315, the majority of which slopes downwardly relative to the plane of floor 2, as shown in FIG. 10. Optionally, sink basin floor 322 may also slope in a second direction toward the drain opening, similar to that described above with respect to FIG. 5.

With continued reference to FIGS. 13-16, basin floor 332 supports faucet 330, auxiliary tray 334, mounts 384, and food preparation apparatus 390. Faucet 330 is disposed on faucet platform 332, which extends upwardly from basin floor 322. Aperture 359 formed in faucet platform 332 permits the fluid communication of faucet 330 with the appropriate plumbing. Auxiliary tray 334 is shown disposed on sink basin floor 322 in a food transfer position for receiving prepared food that is scraped off of cutting board 326.

Figure 17:
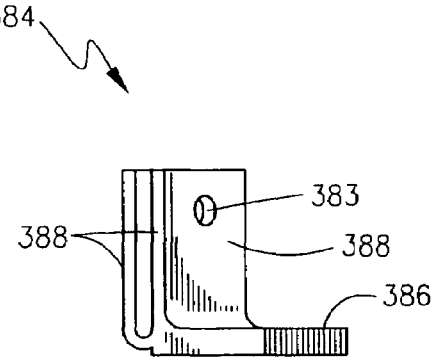
FIG. 17 is a perspective view of a mount used to couple the food preparation apparatus to the sink basin floor.
Figure 18:
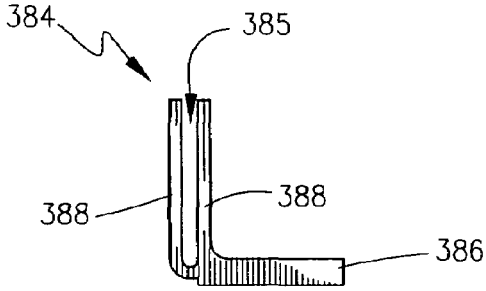
FIG. 18 is a side view in elevation of the mount shown in FIG. 17.

Basin floor 322 includes pair of spaced apart identical mounts 384. Mounts 384 may be affixed or otherwise disposed on basin floor 322 and are adapted to couple food preparation apparatus 390 to basin floor 322, as will be described in more detail below. Mounts 384 may be in the form of slotted brackets such as shown in FIGS. 17 and 18. Turning then to FIGS. 17 and 18, an exemplary bracket 384 includes base 386 and a U-shaped slot 385 formed by a pair of rigid walls 388 that extend upwardly from base 386. Both walls 388 may include apertures formed therethrough, such as aperture 383. Apertures 383 are sized and adapted to receive pins therethrough, as known in the art to provide an alternative mechanism for coupling the food preparation apparatus to the basin floor.

Returning then to FIGS. 14-16, then, it may further be understood that base 386 of mounts 384 confronts basin floor 322 such that upright walls 388 are approximately at a 90° angle "a" with respect to the basin floor. Base 386 may be affixed to basin floor 322 by any suitable method known in the art such as by welding, or may be constructed to be releasably secured thereto, such as by means of suction cups or the like that would permit the releasable attachment of base 386 thereto.

Figure 14:
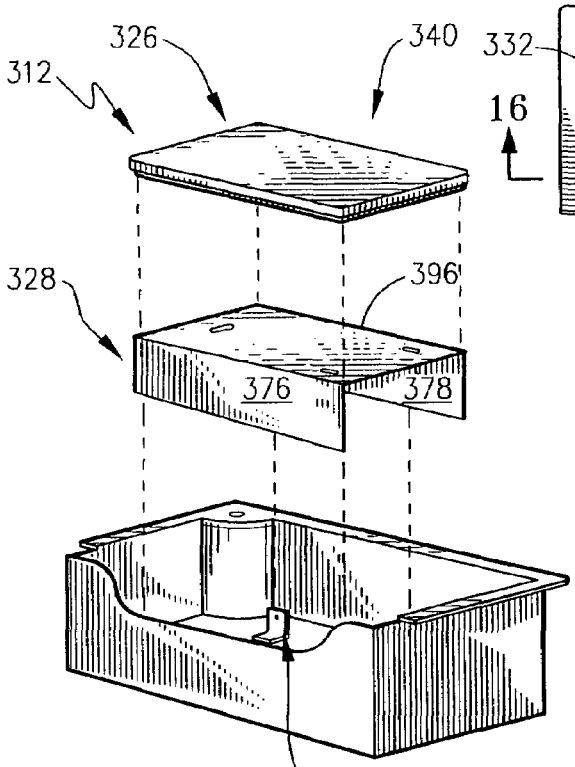
FIG. 14 is an exploded perspective view of the sink assembly shown in FIG. 10, without the faucet.
Figure 15:
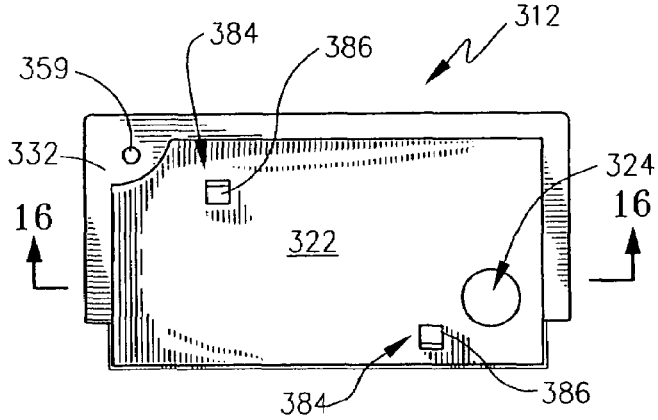
FIG. 15 is a top plan view of the sink assembly shown without the food preparation apparatus.
Figure 16:
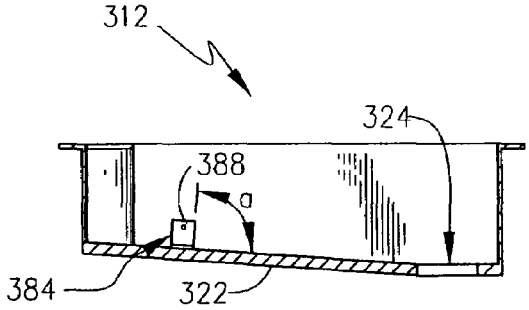
FIG. 16 is a cross-sectional view of the sink assembly taken about lines 16-16 of FIG. 15.

Mounts 384 are adapted to couple food preparation apparatus 390 to basin floor 322, and, more particularly, enable stanchion 328 to be releasably securable to basin floor 322 as shown in FIG. 14. To understand this interrelationship, the features of the food preparation apparatus will first be discussed in more detail with reference to FIGS. 19-21. The food preparation apparatus according to this exemplary embodiment of the present invention generally includes a cutting board supported by a base member, stanchion, or some other structure that supports the cutting board in spaced relation to the basin floor when the food preparation apparatus is in use. The base member or support structure is shown in the FIGS. 19-21 in the form of stanchion 328. Stanchion 328 includes first upright support 392, second upright support 394, end wall 395 extending therebetween, and a bridge piece such as platform 396, which spans upright supports 392, 394. Platform 396 has an upper surface 387 and an oppositely facing lower surface 397. First and second upright supports 392, 394 include a respective lower edge 391 and 393 that is adapted to be coextensive with the sink basin floor when disposed thereon. Stanchion 328 further includes a respective sidewall 376 and 378 extending between platform 396 and a respective lower edge 391, 393.

Figure 19:
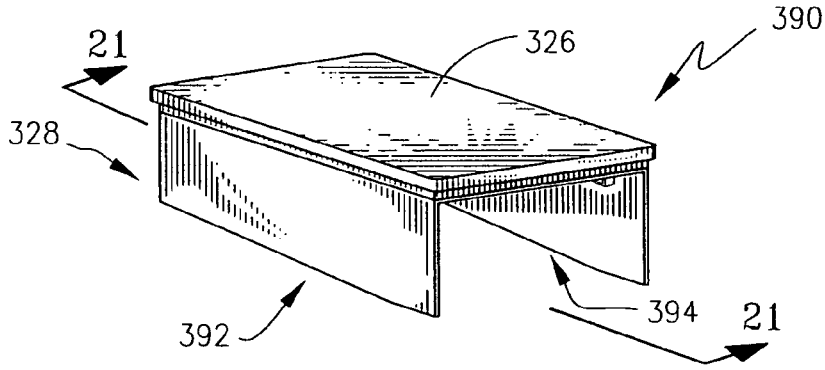
FIG. 19 is a perspective view of the food preparation apparatus, which is one component of the third embodiment of the sink assembly.
Figure 21:
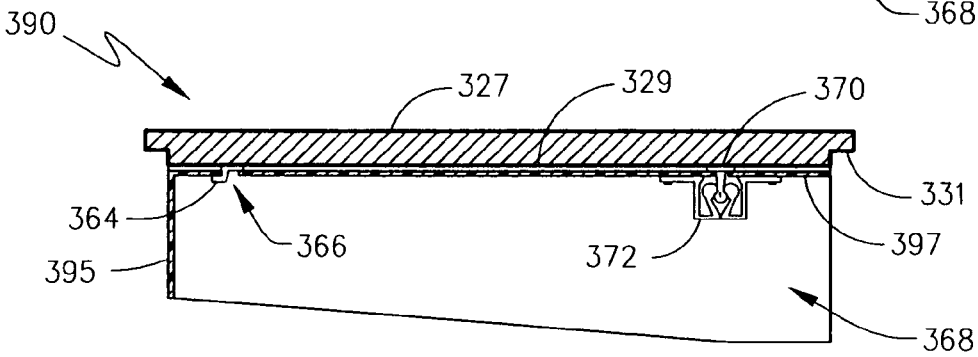
FIG. 21 is a cross-sectional view of the food preparation apparatus taken about lines 21-21 of FIG. 19.

Cutting board 326 has a food preparation surface 327 and an oppositely facing bottom surface 329. When in the assembled state, as shown in FIGS. 19 and 21, bottom surface 329 of cutting board 326 confronts platform 396 of stanchion 328. Preferably, and as perhaps best shown in FIG. 21, cutting board 326 is larger in dimension than platform 396 such that a portion or margin thereof extends beyond platform 396 thereby to define overhanging lip 331.

The food preparation apparatus according to this third exemplary embodiment of the present invention further includes at least one coupling member that is adapted to releasably fasten the cutting board to the stanchion to restrain movement its movement relative to the stanchion when in use. The use of a plurality of coupling members, either of one type or of different types, is contemplated. Coupling members may be, for example, cooperative fasteners disposed respectively on the stanchion platform and the bottom surface of the cutting board and located to secure to one another when in the assembled state to enable the cutting board to be releasably secured to the stanchion platform. For example, the cooperative fasteners contemplated may be selected from the group consisting of tabs and slots, pegs, and clips, magnets, snaps, hook and loop fasteners, and other suitable fastening devices known in the art.

Figure 20:
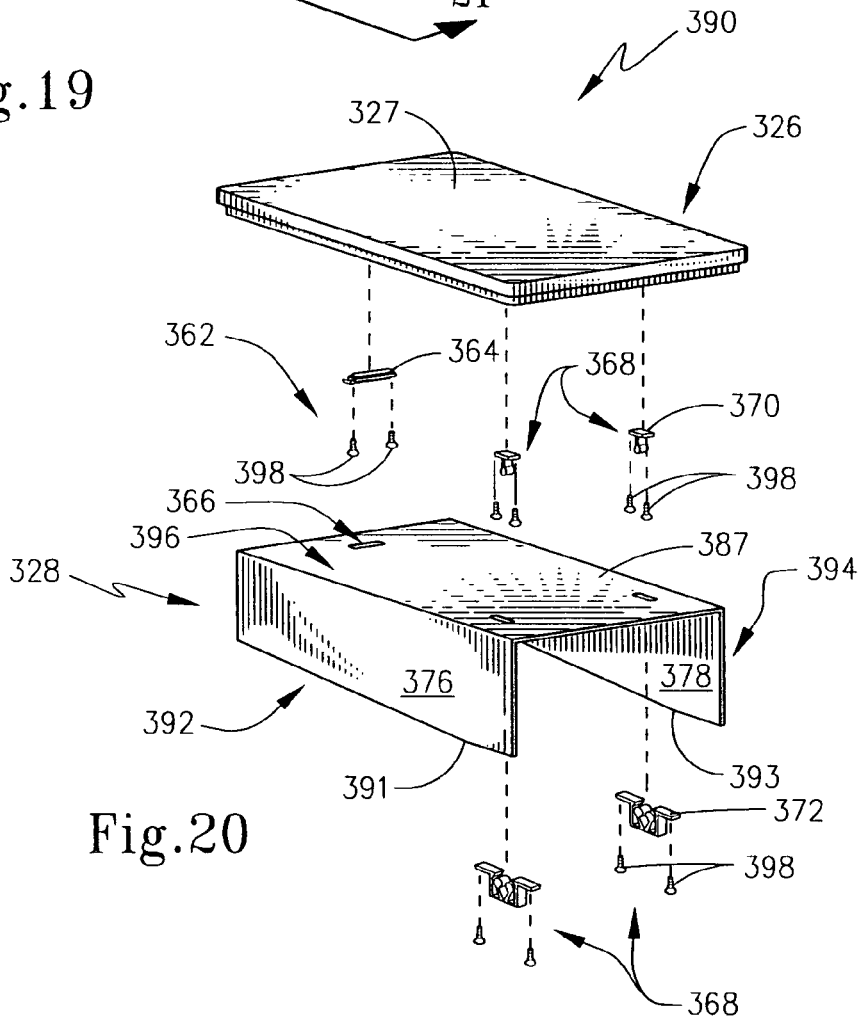
FIG. 20 is an exploded perspective view of the food preparation apparatus shown in FIG. 19.

For illustrative purposes, two different types of coupling members are shown in FIGS. 20 and 21. Particularly, coupling member 362 is shown here as a pair of cooperative fasteners in the form of tab 364 and slot 366. Tab 364 is disposed on bottom surface 329 of cutting board 326 and retained thereto by, for example, threaded screws 398. Slot 366, on the other hand, is formed in platform 396 and is sized and adapted to receive tab 364 and be engaged thereby in a fastened state as is best shown in FIG. 21.

Two additional coupling members 368 are shown here in the form of two identical pairs of cooperative fasteners, exemplified here by peg 370 and spring clip 372. Peg 370 is disposed on bottom surface 329 of cutting board 326 while spring clip 372 is disposed on bottom surface 397 of platform 396. Both peg 370 and clip 372 are retained in place by threaded screws 398. Peg 370 is operative to engage clip 372 when in a fastened state.

With the understanding of the various features of the food preparation apparatus described above, and returning to FIGS. 13-18, then, it may be understood that when sink assembly 312 is assembled, a respective first and second upright support is coupled to sink basin floor 322 by mounts 384. More specifically, a respective stanchion sidewall 376 and 378 is received in slot 385 of a respective mount 384 so as to be releasably securable to sink basin floor 322. As mentioned above with particular reference to FIGS. 17 and 18, a pin associated with mounts 384 and adapted to be received by a respective stanchion sidewall could additionally be used help retain the stanchion sidewalls in place. Further, although two mounts 384 are shown, the use of one appropriately located mount 384 may suffice to releasably secure the stanchion.

Sidewalls 376 and 378 are constructed so that lower edges 391 and 393 are coextensive with basin floor 322 and, when food preparation apparatus is disposed on a downwardly sloping basin floor, platform 396 and cutting board 326 extend in a plane that is generally parallel to the horizontal plane of the support surface when sink assembly 312 is supported thereby.

In addition, when food preparation apparatus 390 is assembled, overhanging lip 331 of cutting board 326 extends over a portion of auxiliary tray 334 when in the tray is in the transfer state, as well as drain opening 324. As should be appreciated, the overhanging margin of cutting board 326 facilitates both the transfer of prepared food to auxiliary tray 334 and waste materials to drain opening 324.

Figure 22:
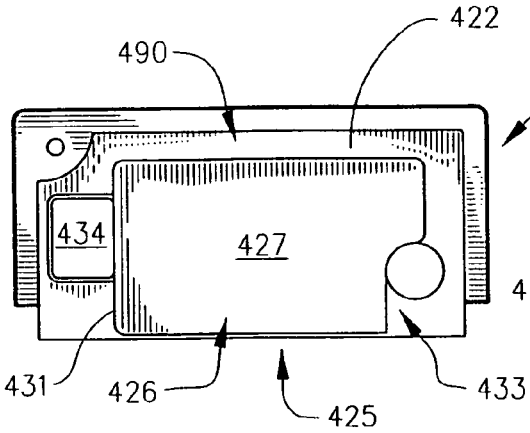
FIG. 22 is a top plan view of a sink assembly according to a fourth exemplary embodiment of the present invention.
Figure 23:
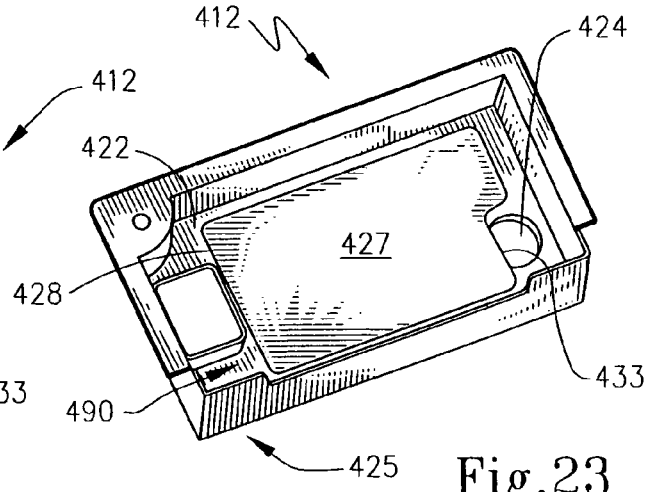
FIG. 23 is a perspective view of the sink assembly shown in FIG. 22.

An alternative food preparation apparatus 490 is shown associated with sink assembly 412 in FIGS. 22 and 23. Sink basin 425, including sink basin floor 422 are constructed in a similar manner as described above with reference to FIGS. 10-12. Additionally, food preparation apparatus 490 is constructed as described above with reference to FIGS. 19-21 to the extent that it includes a stanchion with a platform and a cutting board releasably securable to the platform by means of cooperative fasteners and an overhanging lip 431 that extends over a portion of auxiliary tray 434 when in the tray is in the transfer state. However, as shown in FIGS. 22 and 23, food preparation apparatus 490 includes cut-out portion 433 that is substantially contoured around a vertical projection of drain opening 424.

As may be appreciated by this construction, cutting board 426 still provides an adequately sized planar surface 427 for the preparation of food that may be easily transferred to tray 434. Cut out portion 433 facilitates the removal of waste materials to drain opening 424 and, as may be appreciated by this construction, waste materials may be quickly and readily scraped off the preparation surface 427 and into the drain opening 424. The easy removal of waste materials maximizes the space needed to prepare the food and reduces the time needed to clean the surface of waste materials allowing the preparation of food to become far more efficient.

Figure 24:
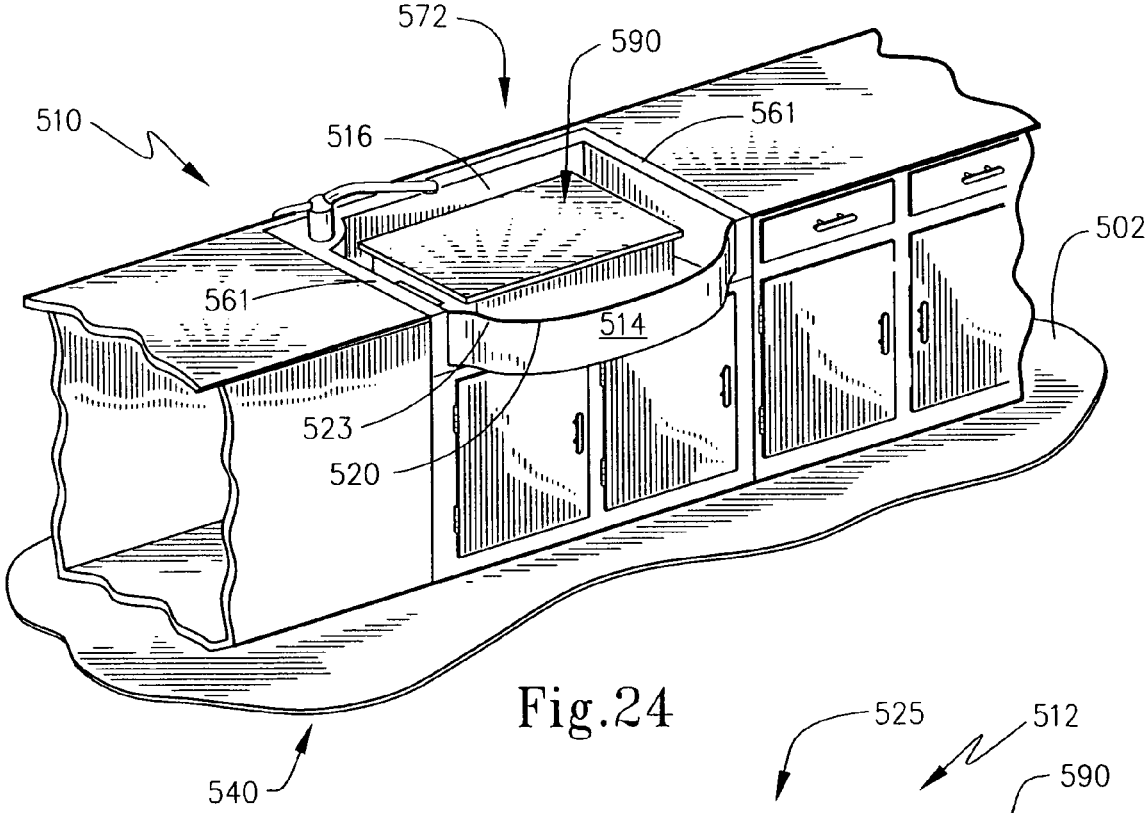
FIG. 24 is a perspective view of a food preparation station according to a fifth exemplary embodiment of the present invention.
Figure 25:
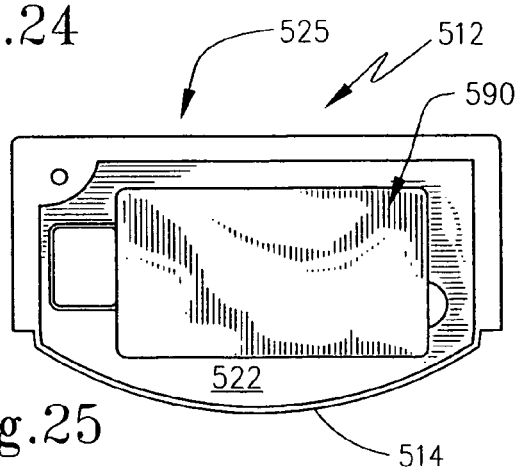
FIG. 25 is a top plan view of the sink assembly shown in FIG. 24.

A fifth exemplary embodiment of the present invention is shown in FIGS. 24 and 25. Food preparation apparatus 590 is constructed as described above with reference to 19-21. However, the construction of sink basin 525 is different from that described above with reference to FIGS. 10-12. More specifically, as shown, front wall 514 is arcuate in shape such that it bows out away from back wall 516 relative to a plane that is generally perpendicular to the horizontal plane of the floor 502. Top edge 523 of front wall 514 tapers from flanges 561 to gap 520 providing an aesthetic contouring of front wall 514. The construction of front wall 514, including the tapering of top edge 523 provides additional aesthetic attributes to food preparation station 510. However, in addition to these aesthetic attributes, and perhaps as best shown in FIG. 25, the construction of front wall 514 creates additional room about food preparation apparatus 590, exposing a larger surface area of sink basin floor 522 as compared to that shown above, for example, in FIG. 13. The additional space provides a larger work environment for preparing food, but may also serve as a convenient location for placing a variety items such as food preparation utensils and other foods that are to be prepared on the cutting board surface.

Figure 26:
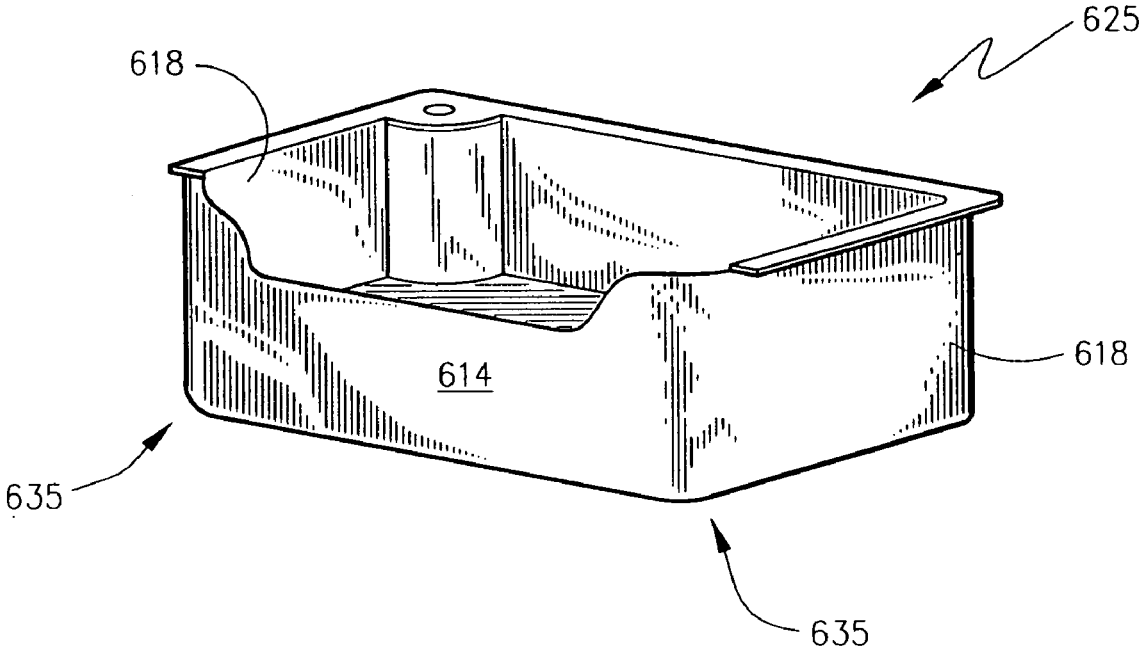
FIG. 26 is a perspective view of an alternative sink basin construction according to a sixth exemplary embodiment of the present invention.
Figure 27:
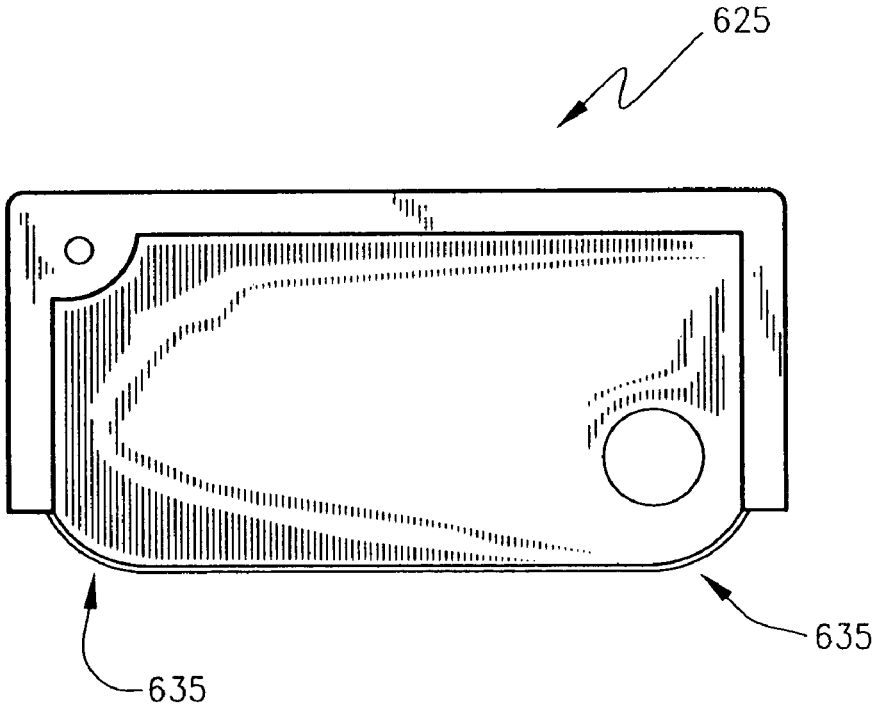
FIG. 27 is a top plan view of the sink basin shown in FIG. 26.

An alternative sink basin 625 is shown in FIGS. 26 and 27. The sink basin shown is constructed as described above with reference to FIGS. 10 and 12 except that it includes rounded corners 635. More particularly, the corner formed between front wall 614 and each respective end wall 618 is arcuate in configuration. Arcuate corners 635 contribute aesthetically to the overall appearance of basin 625 and, as should be appreciated, any one of the food preparation apparatuses described above may be adapted to be used with the sink basin 625.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A food preparation apparatus including a basin floor with a sink having a drain opening formed therethrough and a basin sidewall extending upwardly from said basin floor, comprising:

(A) a stanchion releasably securable to said basin floor and extending upwardly therefrom to terminate in a platform;

(B) a cutting board supported by said stanchion when in an assembled state having a food preparation surface and an oppositely facing bottom surface wherein the bottom surface confronts said platform when in the assembled state; and (C) a coupling member adapted to releasably fasten said cutting board to said stanchion and restrain movement thereof relative to said platform when in the assembled state.

2. A food preparation apparatus according to claim 1 wherein said stanchion includes a sidewall having lower edge that is coextensive with said basin floor.

3. A food preparation apparatus according to claim 1 wherein said stanchion is formed of a material selected from a group consisting of stainless steel and porcelain.

4. A food preparation apparatus according to claim 1 wherein a portion of said cutting board includes a margin that extends beyond said platform to define an overhanging lip.

5. A food preparation apparatus according to claim 1 wherein said cutting board is formed of a material of selected from a group consisting of wood, plastic, ceramic, marble, and a polymethyl methocrylate resin containing a uniformly dispersed alumina trihydrate filler.

6. A food preparation apparatus according to claim 1 including a plurality of coupling members each adapted to restrain movement of said cutting board relative to said platform when in the assembled state.

7. A food preparation apparatus according to claim 1 wherein said coupling member is defined by a pair of cooperative fasteners disposed respectively on said platform and on said cutting board and located to secure to one another when in the assembled state so as to releasably secure said cutting board to said platform.

8. A food preparation apparatus according to claim 7 wherein said pair of cooperative fasteners are selected from the group consisting of tabs and slots, pegs and clips, magnets, snaps, and hook and loop fasteners.

9. A food preparation apparatus according to claim 7 wherein said pair of cooperative fasteners is (A) a tab is disposed on the bottom surface of said cutting board; and (B) a slot formed in said platform that is sized and adapted to receive said tab and be engaged thereby when in the assembled state.

10. A food preparation apparatus according to claim 7 wherein said pair of cooperative fasteners is (A) a spring clip disposed on said platform; and (B) a peg disposed on the bottom surface of said cuffing board and operative to engage said clip.

11. A food preparation apparatus including a basin floor with a sink having a drain opening formed therethrough and a basin sidewall extending upwardly from said basin floor, comprising:

(A) a first upright support releasably securable to said basin floor;

(B) a second upright support spaced apart from said first upright support;

(C) a platform spanning said first and second upright supports and having an upper surface;

(D) a cuffing board releasably securable to said platform and having a food preparation surface and an oppositely facing bottom surface wherein the bottom surface confronts said platform when in an assembled state; and (E) a first pair of cooperative fasteners disposed respectively on said platform and on said cutting board and located to secure to one another in a fastened state so as to releasably secure said cutting board to said platform.

12. A food preparation apparatus according to claim 11 including a mount seated on said basin floor and adapted to couple said first upright support to said basin floor.

13. A food preparation apparatus according to claim 11 wherein said first and second upright supports include a respective sidewall extending between said platform and a respective lower edge wherein each said lower edge is coextensive with said basin floor when disposed thereon.

14. A food preparation apparatus according to claim 11 wherein a portion of said cutting board includes a margin that extends beyond said platform to define an overhanging lip.

15. A food preparation apparatus according to claim 11 including a second pair of cooperative fasteners disposed respectively on said platform and on said cutting board and located to secure to one another in the fastened state so as to releasably secure said cuffing board to said platform.

16. A food preparation apparatus according to claim 15 wherein said second pair of cooperative fasteners is different from said first pair of cooperative fasteners.

17. A food preparation apparatus according to claim 15 wherein said first and said second pair of cooperative fasteners are selected from the group consisting of tabs and slots, pegs and clips, magnets, snaps, and hook and loop fasteners.

18. A sink assembly adapted to be supported in a generally horizontal plane by a horizontal support surface, comprising:

(A) a sink basin including a basin floor with a drain opening formed therethrough and a basin sidewall extending upwardly from said basin floor as a one-piece integral extension thereof to create a basin interior;

(B) a first mount attached to said basin floor;

(C) a base member releasably securable to said basin floor including (1) a first upright support adapted to be engaged by said first mount thereby to restrain movement of said base member relative to said basin floor;

(2) a second upright support spaced apart from said first upright support; and (3) a platform spanning said first and second upright supports and extending in a plane that is generally parallel to the horizontal plane of the support surface; and (D) a cutting board secured to said base member in confronting relation with said platform when in an assembled state.

19. A sink assembly according to claim 18 including a cabinet having a bay formed therein, said sink basin adapted to be disposed in the bay.

20. A sink assembly according to claim 19 including a garbage disposal in fluid communication with the drain opening.

21. A sink assembly according to claim 18 wherein said basin sidewall terminates at an upwardly located, outwardly projecting flange.

22. A sink assembly according to claim 18 wherein said basin sidewall includes (A) a back wall terminating in a rearwardly projecting flange oriented in a first plane;

(B) a front wall spaced apart from said back wall and having a section of reduced height relative to said flange of said back wall, with an upper edge of said section that is generally parallel to the first plane; and (C) two end walls extending between said front wall and said back wall.

23. A sink assembly according to claim 22 wherein said front wall is arcuate in shape such that it bows out away from said back wall and relative to a vertical plane that is generally perpendicular to the horizontal plane of the support surface.

24. A sink assembly according to claim 18 wherein said mount is affixed to said basin floor.

25. A sink assembly according to claim 18 wherein said mount is a slotted bracket.

26. A sink assembly according to claim 18 including a second mount disposed on said basin floor to receive said second upright support.

27. A sink assembly according to claim 18 wherein said basin floor slopes downward toward the drain opening relative to said horizontal support surface.

28. A sink assembly according to claim 27 wherein said first and second upright supports include a respective lower edge that is coextensive with said downward sloping basin floor and wherein said platform extends in a plane that is generally parallel to the horizontal plane of said support surface.

29. A sink assembly according to claim 18 including an auxiliary tray that is adapted to be selectively placed on and supported by said basin floor to define a transfer state.

30. A sink assembly according to claim 29 wherein a portion of said cutting board includes a margin that extends beyond said platform to define an overhanging lip, said overhanging lip extending over said auxiliary tray when said auxiliary tray is in the transfer state.

31. A sink assembly according to claim 18 wherein said cutting board and said platform include a cut out portion that are each, respectively, substantially contoured around a vertical projection of said drain opening.

32. A sink assembly according to claim 18 including a first coupling member adapted to releasably secure said cutting board to said platform and restrain movement thereof relative to said platform when in the assembled state.

33. A sink assembly according to claim 32 including a second coupling member that is adapted to releasably secure said cutting board to said platform and restrain movement thereof relative to said platform when in the assembled state.

34. A sink assembly according to claim 33 wherein said first and said second coupling members are each a respective first and second pair of cooperative fasteners disposed respectively on said platform and on said cutting board and located to secure to one another when in the assembled state so as to releasably secure said cutting board to said platform.

35. A sink assembly according to claim 34 wherein said first and second pairs of cooperative fasteners are selected from the group consisting of tabs and slots, pegs and clips, magnets, snaps, and hook and loop fasteners.

36. A food preparation station adapted to be supported in a generally horizontal plane by a horizontal support surface comprising:

(A) a sink basin including (1) a basin floor with a drain opening formed therethrough;

(2) a basin sidewall extending upwardly from said basin floor as a one piece integral extension thereof to create a sink basin interior; and (3) a mount attached to said basin floor;

(B) a base member releasably securable to said basin floor including (1) a pair of upright walls each having a respective lower edge that is generally coextensive with said basin floor so as to confront said basin floor when said base member is disposed thereon and wherein a selected one of said upright walls is received by said mount thereby to restrain movement of said base member relative to said basin floor; and (2) a bridge member spanning said upright walls;

(C) a cutting board secured to said base member and extending in a plane generally parallel to the horizontal plane of said support surface when in an assembled state.

37. A food preparation station according to claim 36 wherein said basin floor slopes downward toward the drain opening relative to the horizontal support surface.

38. A food preparation station according to claim 36 wherein said basin sidewall includes (A) a back wall terminating in a rearwardly projecting flange oriented in a first plane;

(B) a front wall spaced apart from said back wall and having a section of reduced height relative to the top surface of said back wall, with an upper edge of said section that is generally parallel to the first plane; and (C) two end walls extending between said front wall and said back wall.

39. A food preparation station according to claim 38 wherein said front wall is arcuate in shape such that it bows out away from said back wall and relative to a vertical plane that is generally perpendicular to the horizontal plane of the support surface.

40. A food preparation station according to claim 36 including a coupling member adapted to releasably fasten said cutting board to said base member and restrain movement thereof relative to said platform when in the assembled state.

41. A food preparation station according to claim 36 wherein said cuffing board and said platform include a cut out portion that are each, respectively, substantially contoured around a vertical projection of said drain opening.

* * * * *